US005234546A

United States Patent [19]

Chamblee

[11] Patent Number: 5,234,546

[45] Date of Patent: Aug. 10, 1993

[54] POLYSULFIDE PRODUCTION IN WHITE LIQUOR

[75] Inventor: Wayne Chamblee, Glens Falls, N.Y.

[73] Assignee: Kamyr, Inc., Glens Falls, N.Y.

[21] Appl. No.: 877,724

[22] Filed: May 4, 1992

Related U.S. Application Data

[63] Continuation-in-part of Ser. No. 788,151, Nov. 5, 1991, and a continuation-in-part of Ser. No. 756,849, Sep. 10, 1991.

[51] Int. Cl.[5] ..... D21C 11/00

[52] U.S. Cl. ..... 162/14; 162/15; 162/29; 162/30.11; 48/198.1; 423/DIG. 3

[58] Field of Search ..... 162/30.11, 14, 15, 29; 48/197, 209; 208/215, 217; 423/655, 656, DIG. 3; 585/733; 423/245.1, 564; 204/256

[56] References Cited

U.S. PATENT DOCUMENTS

| | | | |
|---|---|---|---|
| 2,135,879 | 11/1938 | Shiffler et al. | 23/134 |
| 4,024,229 | 5/1977 | Smith et al. | 423/562 |
| 4,067,767 | 1/1978 | Hess et al. | 162/31 |
| 4,544,461 | 10/1985 | Venkatesan et al. | 204/128 |
| 4,553,981 | 11/1985 | Fiderer | 423/655 |
| 4,959,079 | 9/1990 | Grotz et al. | 252/373 |
| 4,960,506 | 10/1990 | Halbert et al. | 208/215 |
| 5,082,526 | 1/1992 | Dorris | 162/30.11 |

OTHER PUBLICATIONS

"All It Takes is MOXY: Mead Oxidation System Generates Polysulfide Liquor," Smith et al., Paper Trade Journal, May 1, 1975, four pages.

"The Lummus Pollution-Controlled Polysulfide Recovery Process", Fogman, The 1972 Alkaline Pulping Conference of Tappi, Sep. 1972, pp. 1-11.

"Polysulphide pulping of two Canadian softwood blends", Green et al., Pulp & Paper Canada, 76, No. 9, T272-T275, Sep. 1975.

*Primary Examiner*—Peter Chin
*Assistant Examiner*—Dean Tan Nguyan
*Attorney, Agent, or Firm*—Nixon & Vanderhye

[57] ABSTRACT

Off gases from black liquor heat treatment, evaporators, wood pulp digesters, etc. are treated to produce primarily hydrogen sulfide and sulfur free fuel gases such as methane, carbon monoxide, hydrogen, and ethylene. Then the hydrogen sulfide is used to produce sodium polysulfide in white liquor for cooking wood chips to produce pulp by the kraft process. Polysulfide may be formed in three different ways: by supplying air to a fuel cell into which white liquor and the hydrogen sulfide containing gas have been introduced; by bringing clarified white liquor and hydrogen sulfide containing gas into contact with a wet-proofed activated carbon catalyst and oxygen containing gas; or by bringing unclarified white liquor into contact with the gas and oxygen containing gas, with lime mud acting as a catalyst, and then clarifying the polysulfide-rich white liquor produced to remove the lime mud. The white liquor produced contains about 0.5-8% on wood sodium polysulfide.

21 Claims, 2 Drawing Sheets

POLYSULFIDE PRODUCTION IN WHITE LIQUOR

CROSS-REFERENCE TO RELATED APPLICATIONS

This application is a continuation-in-part of application Ser. No. 07/788,151 filed Nov. 5, 1991, and a continuation in-part of Ser. No. 07/756,849 filed Sep. 10, 1991, the disclosures of which are incorporated by reference herein.

BACKGROUND AND SUMMARY OF THE INVENTION

As reported in parent application Ser. No. 07/788,151, the utilization of polysulfide in an amount of about 0.5–8% on wood, expressed as elemental sulfur, when used in conjunction with extended modified continuous cooking, produces a kraft pulp with good Kappa, viscosity and yield. It has now been found according to the present invention that the high sulfide content white liquor that is produced according to the parent applications is eminently suited for use in the production of polysulfide so as to get the advantageous results described in parent application Ser. No. 07/788,181.

According to the invention, the hydrogen sulfide containing gas stream generated during the treatment of organic sulfur gases is contacted with white liquor to form a solution containing sodium hydrosulfide. The sodium hydrosulfide containing liquid is then reacted with oxygen or an oxygen containing gas (containing sufficient oxygen to get the desired results) under suitable conditions while in the presence of a suitable catalyst to yield sodium polysulfide and sodium hydroxide. Hydrogen sulfide may also be generated in situ by the addition of sulfur, in the form of elemental sulfur, which may be generated in processing according to the present invention (e.g. in a fuel cell). Thus according to the invention, it is possible to very effectively produce and utilize a sodium polysulfide containing cooking liquor when treating black liquor.

According to one aspect of the present invention, a method of kraft pulping of comminuted cellulosic fibrous material with white liquor containing sodium polysulfide, and creation of the polysulfide in the white liquor from a first gas stream including over 10% by weight organic sulfur compounds, is provided. The method comprises the following steps: (a) Adding hydrogen to the gas in the first gas stream. (b) Passing the first gas stream, in the presence of the added hydrogen, past a hydrogen desulfurization catalyst to produce a second gas stream containing primarily hydrogen sulfide and sulfur free fuel gas such as methane, carbon monoxide, hydrogen, and ethylene. (c) Bringing the second gas stream into operative contact with white liquor and with other chemicals, and under selected conditions, effective to produce sodium polysulfide in the white liquor. And, (d) using the white liquor, with sodium polysulfide, in a kraft process to treat comminuted cellulosic fibrous material to produce cellulosic pulp. Typically steps (c) and (d) are practiced to produce and utilize white liquor containing about 0.5–8% sodium polysulfide on wood.

Alternatively, instead of steps (a) and (b), there may be the step (a1) of effecting substoichiometric combustion of the gas in the first stream to produce the second stream. The actual production of the polysulfide may take place in a number of different manners. For example step (c) may be practiced by utilizing a fuel cell, which ultimately produces electrical energy. Fuel cells which can be used for these purposes is described in U.S. Pat. Nos. 4,544,461 and 4,320,180, the disclosures of which are hereby incorporated by reference herein. According to this procedure, the second gas stream is reacted with the fuel cell with some form of gaseous oxygen to produce elemental sulfur. Then the elemental sulfur is added to the white liquor so as to produce sodium polysulfide in the white liquor, such as according to the formula:

$$2\ NaHS + 2x - 1\ S \rightarrow 2\ NaS_x + H_2S.$$

As another alternative, step (c) may be practiced by utilizing the MOXY TM process in which a wet-proofed activated carbon catalyst is utilized, such as described in U.S. Pat. No. 4,024,229 (the disclosure of which is hereby incorporated by reference herein). According to this method, a second gas stream is passed into contact with clarified white liquor, and then the clarified white liquor is passed into contact with a wet-proofed activated carbon catalyst and some form of gaseous oxygen to promote the generation of sodium polysulfide in the white liquor. Typical reactions for producing sodium polysulfide according to this procedure are as follows:

$$H_2S + NaOH \rightarrow NaHS + H_2O$$

$$2\ NaHS + O_2 \rightarrow 2\ S + 2\ NaOH$$

$$Na_2S + S \rightarrow Na_2S_x$$

According to another aspect of the invention, step (c) is practiced by passing the second gas stream into contact with unclarified white liquor (having metals present therein), and some form of gaseous oxygen, to produce white liquor containing sodium polysulfide, the reaction catalyzed by lime mud existing in the unclarified white liquor. E.g. see U.S. Pat. No. 5,082,526. Then, the white liquor is clarified to remove the lime mud from it.

The gas in the first gas stream includes substantial amounts of water vapor, and there is also typically the further step (e) of drying the gas in the first gas stream before the practice of step (a). Also there is preferably the further step of utilizing a second white liquor, having a significantly lower sulfur content, and polysulfide (if any) content, than the white liquor produced in step (c) and utilized in step (d), to treat the comminuted cellulosic material after step (d).

According to another aspect of the present invention, a method of kraft pulping of comminuted cellulosic fibrous material with white liquor containing sodium polysulfide, and creation of the polysulfide in the white liquor from off gases from black liquor treatment, is provided. This method comprises the following steps: (a) Acting upon black liquor to obtain off gases containing organic sulfur compounds, and collecting the off gases. (b) Treating the off gases to produce a gas stream containing primarily hydrogen sulfide and methane or other non-sulfur containing fuel gases. (c) Bringing the gas stream into operative contact with white liquor and with other chemicals, and under such conditions, effective to produce sodium polysulfide in the white liquor. And, (d) using the white liquor, with sodium polysulfide, in a kraft process to treat comminuted cellulosic fibrous material to produce cellulosic pulp. Step (c) in each case may be practiced in the same manner as step (c) according to the first aspect of the invention, that is by utilizing a fuel cell, the MOXY TM process, or an oxidation reaction with unclarified white liquor.

According to yet another aspect of the invention, an apparatus for producing white liquor having sodium polysulfide therein is provided. The apparatus comprises the following elements: Means for acting upon black liquor to produce organic sulfur containing off gases, and collecting the off gases (such as shown in U.S. Pat. No. 4,929,307, the disclosure of which is hereby incorporated by reference herein). Hydrogen desulfurization means for reacting the black liquor off gases (e.g. with hydrogen in the presence of a catalyst, or substoichiometrically) to produce primarily hydrogen sulfide and methane. A hydrogen sulfide fuel cell system for producing electrical energy. A conduit connecting the hydrogen desulfurization means to the fuel cell. A white liquor inlet to the fuel cell, a fuel gas outlet from the fuel cell, an oxygen containing gas inlet to the fuel cell, and a polysulfide containing white liquor outlet from the fuel cell. Means for treating comminuted cellulosic material with polysulfide containing white liquor. And, a conduit connecting the fuel cell polysulfide containing white liquor outlet to the means for treating comminuted cellulosic material with polysulfide containing white liquor.

It is the primary object of the present invention to provide a simple and effective way of producing sodium polysulfide in white liquor for the enhanced kraft cooking of pulp. This and other objects of the invention will become clear from an inspection of the detailed description of the invention, and from the appended claims.

DETAILED DESCRIPTION OF THE DRAWINGS

Figure 1:
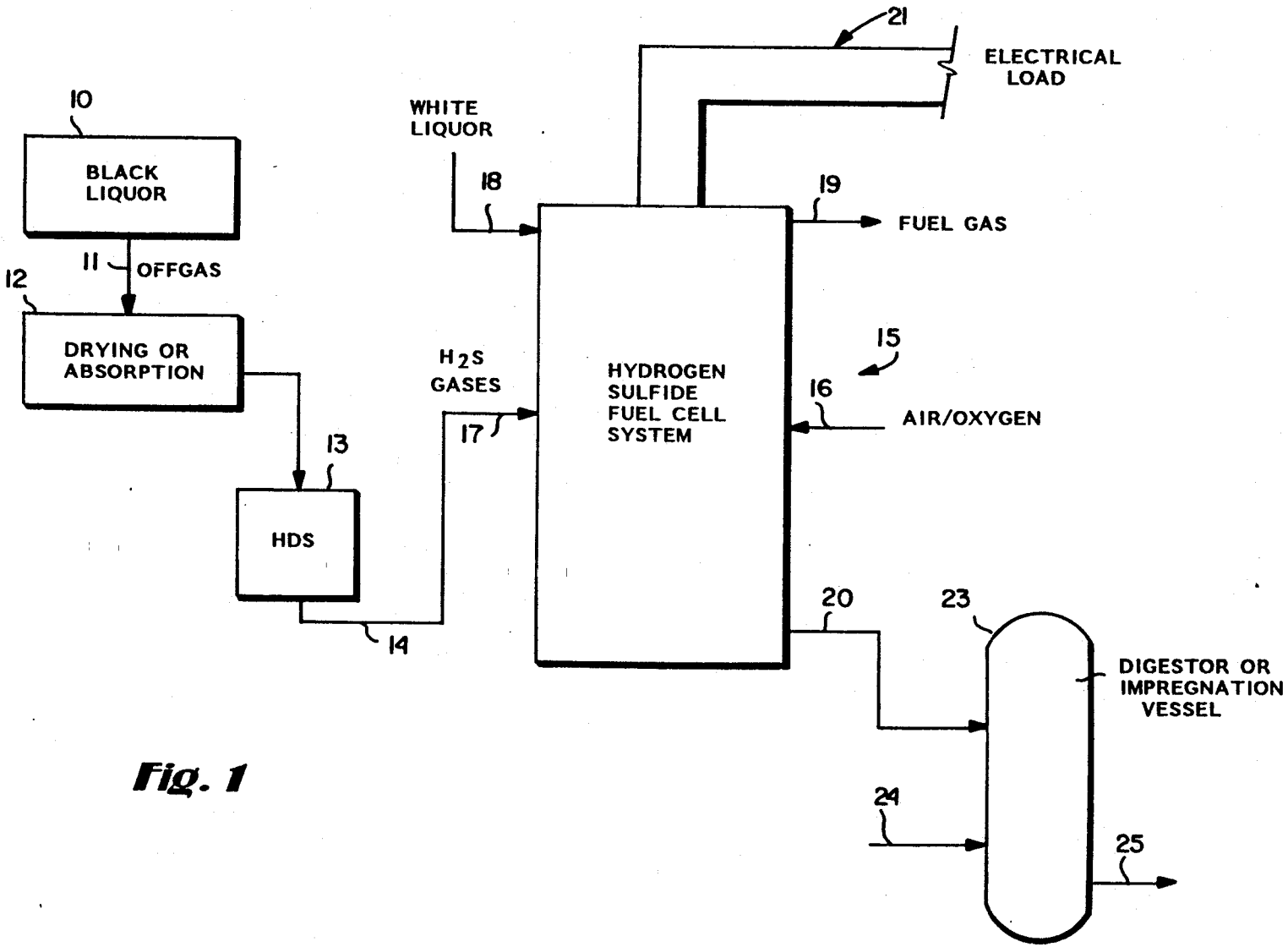
FIG. 1 is a schematic view showing a first embodiment of apparatus according to the invention for producing sodium hydrosulfide in white liquor.

FIG. 1 schematically illustrates an exemplary method according to the invention, utilizing apparatus according to the invention, for producing a polysulfide rich cooking liquor for kraft cooking of comminuted cellulosic fibrous material (e.g. wood chips) in the production of kraft pulp. Black liquor from the pulping process, indicated at box 10 in FIG. 1, is treated to produce off gases in line 11. These off gases in line 11 may be from the black liquor evaporators, may include digester off gases or the like, but are preferably primarily obtained from heating black liquor at a temperature of about 170°-270° C. at such pressure and for such time so as to split the macro-molecular lignin fractions, e.g. as described in U.S. Pat. No. 4,929,307. The off gases in line 11 contain at least 10%—and typically a very high percentage (e.g. about 15-80%)—by weight organic sulfur compounds. The organic sulfur compounds typically present are methyl mercaptan, DMS, and hydrogen sulfide, although many other compounds are also present, (e.g. water vapor, methane, and ketones).

As described in the parent application Ser. No. 07/756,849, the off gases from line 11 typically are dried at stage 12 in order to remove the majority of the water vapor therefrom, and then passed to a suitable hydrogen desulfurization catalyst block 13 in which a gas in stream from the line 11, in the presence of added hydrogen and a hydrogen desulfurization catalyst such as nickel molybdenum or cobalt molybdenum, decomposes to produce primarily methane (and other non-sulfur fuel gases) and hydrogen sulfide. From there, the gas stream in line 14 is led to the hydrogen sulfide fuel cell system 15. Instead of block 13, the gas stream in line 11 may be substoichiometrically combusted (i.e. subjected to partial oxidation) to produce the gas stream in line 14.

The term "methane" as used hereafter in the specification and claims means both $CH_4$ and other non-sulfur fuel gases, such as hydrogen, carbon monoxide, and ethylene.

The hydrogen sulfide fuel cell system 15 preferably is the type such as shown in U.S. Pat. Nos. 4,320,180 and 4,544,461 in which catalytic materials are incorporated in an anode for use in an electrolytic cell for removing sulfur from the hydrogen sulfide from the gas in line (conduit) 14. In the hydrogen sulfide fuel system 15, oxygen (either in pure oxygen form, or in the form of an oxygen containing gas such as air) is added in inlet 16 while the hydrogen sulfide containing gases are added in line 17, white liquor is added in inlet 18, fuel gas moves out of the system 15 into outlet 19, and polysulfide cooking liquor is discharged from the fuel cell 15 in line (conduit) 20. Also electrical energy—as illustrated schematically at 21 in FIG. 1—is produced by the fuel cell system 15.

The term "oxygen" as used hereafter in the specification and claims encompasses both essentially pure oxygen, and other oxygen containing gases (such as air) which have enough oxygen to achieve the desired results.

In the fuel cell system 15, elemental sulfur is actually produced in the fuel cell, which then is reacted with the white liquor added by inlet 18 to form sodium polysulfide according to the equation:

$$2\ NaHS + 2x - 1\ S \rightarrow 2\ NaS_x + H_2S.$$

This equipment can also be modified to allow for the electrolysis of hydrogen sulfide in the production of a hydrogen gas, or can be operated using redox solution as described in U.S. Pat. Nos. 4,320,180 and 4,544,461.

The white liquor in line 20 typically contains about 0.5-8% polysulfide on wood, which is added to a digester or impregnation vessel 23 for the production of kraft pulp. If desired, a split sulfidity process may be utilized in which a second white liquor added at line 24 is added in a stage after the liquor from line 20. The liquor in line 20 has a very high sulfide content compared to the second white liquor added in line 24. The liquor in line 24 typically has no polysulfide, although it may contain a small amount. The final pulp produced in line 25 has the advantageous features ascribed to such pulp, for example as detailed in parent application Ser. No. 07/788,151.

Figure 2:
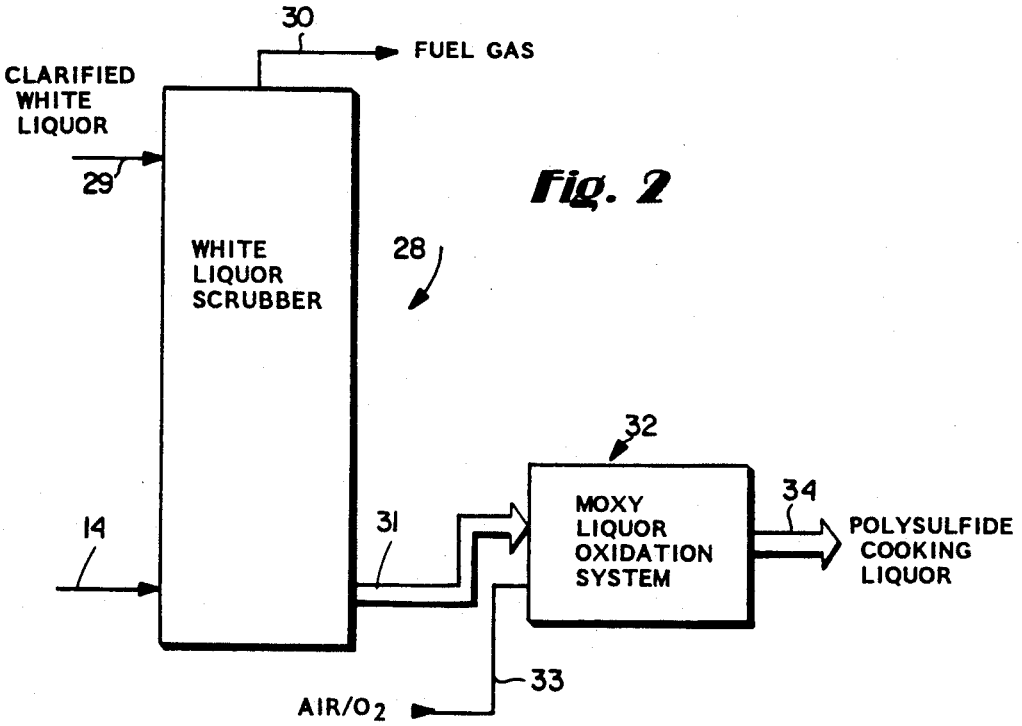
FIGS. 2 and 3 are schematic views of two alternative methods that may be utilized for the production of polysulfide cooking liquor according to the invention.

FIG. 2 illustrates schematically another alternative method for producing polysulfide cooking liquor according to the present invention. According to this method, the primarily hydrogen sulfide and methane gases in conduit 14 are added to a white liquor scrubber 28, coming in contact with clarified white liquor added at 29 to the scrubber 28. The scrubber 28 selectively absorbs the hydrogen sulfide, leaving the methane—with other constituents—available to be withdrawn at 30 as fuel gas (e.g. fed to the lime kiln of a pulp mill). The high sulfide content white liquor produced exits the scrubber 28 in line 31 and then passes to a MOXY TM liquor oxidation system 32.

In the system 32—such as described in U.S. Pat. No. 4,024,229—a wet-proofed activated carbon catalyst promotes the generation of sodium polysulfide during reaction of oxygen from an oxygen containing gas (such as air) added in line 33 with clarified white liquor containing sulfide, to produce polysulfide. Typical reactions include:

$$H_2S + NaOH \rightarrow NaHS + H_2O$$

$$2\ NaHS + O_2 \rightarrow 2\ S + 2\ NaOH$$

$$Na_2S + S \rightarrow Na_2S_x.$$

The polysulfide rich white liquor is then discharged at 34, and again used in a digesting or impregnation vessel 23 or the like.

Figure 3:
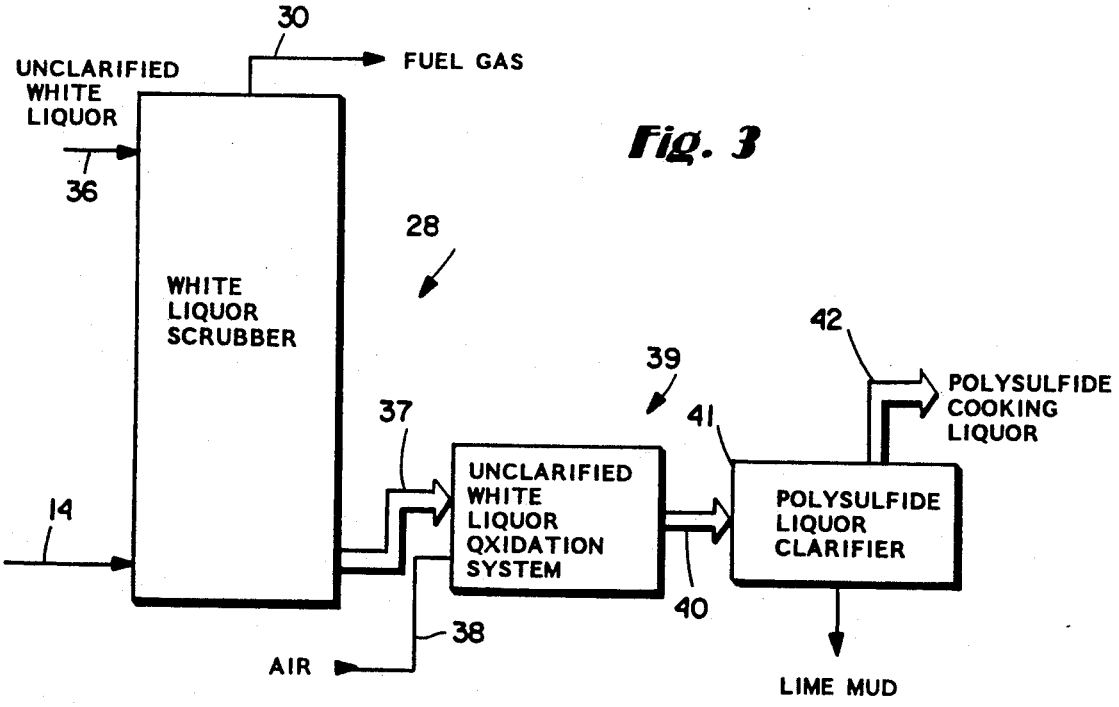

FIG. 3 illustrates yet another method for producing polysulfide cooking liquor according to the invention. In the system of FIG. 3 a white liquor scrubber 28, essentially the same as that of the FIG. 2 embodiment, is utilized to scrub the hydrogen sulfide gases from those introduced in line 14, while fuel gas exits in line 30 (the process of FIG. 3 may utilize apparatus such as described in U.S. Pat. No. 5,082,526, the disclosure of which is hereby incorporated by reference herein). However the white liquor added to the scrubber 28 in FIG. 3 is unclarified white liquor, added at line 36. The high sulfide unclarified white liquor that exits in conduit 37 is reacted with an oxygen containing gas, such as air from line 38, in an unclarified white liquor oxidation system 39. The unclarified white liquor contains metals, such as oxides and sulfides of manganese, iron, cobalt, nickel, zinc, copper, and the like, a number of which are water insoluble, such as iron sulfide and nickel sulfide. That is in the oxidation system 39 lime mud acts as the catalyst for the desired oxidation reaction, to produce polysulfide of about 0.5–8% on wood that is discharged in line 40. Before the polysulfide-rich white liquor in line 40 can be utilized to produce paper pulp, however, it must be clarified in the clarifier 41, and after the lime mud is removed therefrom the polysulfide-rich white liquor in line 42 may be used in the digester impregnation vessel 23 as described above with respect to the FIG. 1 embodiment.

While the scrubbers 28 and oxidation units 32, 39 respectively are illustrated in FIGS. 2 and 3 as separate units, they may be combined into a single unit in each of FIGS. 2 and 3.

It will thus be seen that according to the present invention in simple yet effective manners hydrogen sulfide in gases produced from the off gases of black liquor heating, or the like, greatly facilitate the production of sodium polysulfide in white liquor, enhancing the production capabilities of the white liquor in manners known in the art per se. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and systems.

What is claimed is:

1. A method of kraft pulping of comminuted cellulosic fibrous material with white liquor containing sodium polysulfide, and creation of the polysulfide in the white liquor for a first black liquor gas stream for the off gases of the evaporators, digester, and black liquor treatment comprising means for heating black liquor at a temperature of about 170°–270° C. at such pressure and for such time as to split the macro-molecular lignin fractions, including over 10% by weight organic sulfur compounds, comprising the steps of:

(a) hydrogen desulfurizing or substoichiometrically combusting the first gas steam to produce a second gas stream containing primarily hydrogen sulfide and methane;

(b) brining the second gas stream into operative contact with white liquor and with other chemicals, and under selected conditions, effective to produce sodium polysulfide in the white liquor; and (c) using the white liquor, with sodium polysulfide, in a kraft process to treat communited cellulosic fibrous material to produce cellulosic pulp.

2. A method as recited in claim 1 wherein steps (b) and (c) are practiced to produce and utilize white liquor containing about 0.5–8% sodium polysulfide on wood.

3. A method as recited in claim 2 wherein step (b) is practiced by utilizing a fuel cell, and by (b1) adding the second gas stream, with hydrogen sulfide, to the fuel cell with oxygen to produce elemental sulfur; and (b2) adding the elemental sulfur to the white liquor so as to produce sodium polysulfide in the white liquor.

4. A method as recited in claim 2 wherein step (b) is practiced by (b1) passing the second gas stream into contact with clarified white liquor, and then (b2) passing the white liquor into contact with a wet-proofed activated carbon catalyst and oxygen to promote the generation of sodium polysulfide in the white liquor.

5. A method as recited in claim 2 wherein step (b) is practiced by (b1) passing the second gas stream into contact with unclarified white liquor, having metals present therein, and oxygen, to produce white liquor containing sodium polysulfide, catalyzed by lime mud existing in the unclarified white liquor, and (b2) clarifying the polysulfide containing white liquor to remove lime mud therefrom.

6. A method as recited in claim 1 wherein step (b) is practiced by utilizing a fuel cell, and by (b1) adding the second gas stream, with hydrogen sulfide, to the fuel cell with oxygen to produce elemental sulfur; and (b2) adding the elemental sulfur to the white liquor so as to produce sodium polysulfide in the white liquor.

7. A method as recited in claim 1 wherein step (b) is practiced by (b1) passing the second gas stream into contact with clarified white liquor, and then (b2) passing the white liquor into contact with a wet-proofed activated carbon catalyst and oxygen to promote the generation of sodium polysulfide in the white liquor.

8. A method as recited in claim 1 wherein step (b) is practiced by (b1) passing the second gas stream into contact with unclarified white liquor, having metals present therein, and oxygen, to produce white liquor containing sodium polysulfide, catalyzed by lime mud existing in the unclarified white liquor, and (b2) clarifying the polysulfide containing white liquor to remove lime mud therefrom.

9. A method as recited in claim 1 wherein step (a) is practiced by substoichiometric combustion.

10. A method as recited in claim 1 wherein step (a) is practiced by adding hydrogen to the gas in the first stream, and passing the first gas stream past a hydrogen desulfurization catalyst.

11. A method as recited in claim 1 wherein the gas in the first gas stream includes substantial amounts of water vapor, and comprising the further step (d) of drying the gas in the first gas stream before the practice of step (a).

12. A method as recited in claim 1 comprising the further step of utilizing a second white liquor, having a significantly lower sulfur content, and polysulfide content, than the white liquor produced in step (c) and utilized in step (d), to treat the communited cellulosic material after step (d).

13. A method of kraft pulping of comminuted cellulosic fibrous material with white liquor containing sodium polysulfide, and creation of the polysulfide in the white liquor from off gases of black liquor treatment, comprising the steps of:

(a) heating the black liquor at a temperature of about 170°-270° C. at such a pressure and for such a time so as to split the macro-molecular lignin fractions to obtain off gases containing organic sulfur compounds, and collecting the off gases;

(b) hydrogen desulfurizing or substoichiometrically combusting the off gases to produce a gas stream containing primarily hydrogen sulfide and methane;

(c) bringing the gas stream into operative contact with white liquor and with other chemicals, and under such conditions, effective to produce sodium polysulfide in the white liquor; and (d) using the white liquor, with sodium polysulfide, in a kraft process to treat comminuted cellulosic fibrous material to produce cellulosic pulp.

14. A method as recited in claim 13 wherein steps (c) and (d) are practiced to produce white liquor containing about 0.5-8% sodium polysulfide by weight.

15. A method as recited in claim 14 wherein step (c) is practiced by utilizing a fuel cell, and by (c1) adding the gas stream, with hydrogen sulfide, to the fuel cell with oxygen to produce elemental sulfur; and (c2) adding the elemental sulfur to the white liquor so as to produce sodium polysulfide in the white liquor.

16. A method as recited in claim 14 wherein step (c) is practiced by (c1) passing the gas stream, with hydrogen sulfide, into contact with clarified white liquor, and then (c2) passing the white liquor into contact with a wet-proofed activated carbon catalyst and oxygen to promote the generation of sodium polysulfide in the white liquor.

17. A method as recited in claim 14 wherein step (c) is practiced by (c1) passing the hydrogen sulfide into contact with unclarified white liquor, having metals present therein, and oxygen, to produce white liquor containing sodium polysulfide, catalyzed by lime mud existing in the unclarified white liquor, and (c2) clarifying the polysulfide containing white liquor to remove lime mud therefrom.

18. A method as recited in claim 13 wherein step (c) is practiced by utilizing a fuel cell, and by (c1) adding the second gas stream, with hydrogen sulfide, to the fuel cell with oxygen to produce elemental sulfur; and (c2) adding the elemental sulfur to the white liquor so as to produce sodium polysulfide in the white liquor.

19. A method as recited in claim 13 wherein step (c) is practiced by (c1) passing the second gas stream into contact with clarified white liquor, and then (c2) passing the white liquor into contact with a wet-proofed activated carbon catalyst and oxygen to promote the generation of sodium polysulfide in the white liquor.

20. A method as recited in claim 13 wherein step (c) is practiced by (c1) passing the second gas stream into contact with unclarified white liquor, having metals present therein, and oxygen, to produce white liquor containing sodium polysulfide, catalyzed by lime mud existing in the unclarified white liquor, and (c2) clarifying the polysulfide containing white liquor to remove lime mud therefrom.

21. A method as recited in claim 13 comprising the further step of utilizing a second white liquor, having a significantly lower sulfur content, and polysulfide content, than the white liquor produced in step (c) and utilized in step (d), to treat the comminuted cellulosic material after step (d).

* * * * *